United States Patent [19]

Yamasaki

[11] 4,258,294

[45] Mar. 24, 1981

[54] CONTROL CIRCUIT FOR FLASH TUBE APPARATUS

[75] Inventor: Masafumi Yamasaki, Hachioji, Japan

[73] Assignee: Olympus Optical Co., Ltd., Tokyo, Japan

[21] Appl. No.: 25,881

[22] Filed: Apr. 2, 1979

[30] Foreign Application Priority Data

May 12, 1978 [JP] Japan ..... 53-56830

[51] Int. Cl.[3] ..... H05B 41/32

[52] U.S. Cl. ..... 315/151; 315/159; 315/241 P

[58] Field of Search ..... 315/151, 159, 241 P; 354/33, 60 F, 137, 145

[56] References Cited

U.S. PATENT DOCUMENTS

| | | | |
|---|---|---|---|
| Re. 28,025 | 5/1974 | Murata et al. | 315/151 |
| 3,814,985 | 6/1974 | Pecher et al. | 315/241 P |
| 3,835,351 | 9/1974 | Schneider | 315/241 P |
| 4,007,398 | 2/1977 | Nakamura et al. | 315/151 |
| 4,091,308 | 5/1978 | Schneider | 315/159 X |

FOREIGN PATENT DOCUMENTS

| | | | |
|---|---|---|---|
| 2338968 | 2/1975 | Fed. Rep. of Germany | 354/33 |
| 4430905 | 12/1969 | Japan . | |

*Primary Examiner*—Eugene R. LaRoche

[57] ABSTRACT

A control circuit for flash tube apparatus has a flash tube, a thyristor for controlling the flash tube in ON-OFF fashion, a trigger circuit for triggering the flash tube and thyristor, a commutation capacitor for turning the thyristor OFF, a switch circuit for supplying a charge stored in the commutation capacitor to the cathode-to-anode path of the thyristor. The control circuit further includes a trigger blocking circuit connected between the trigger circuit and the gate of the thyristor, a carrier recombination capacitor connected in parallel with and across the gate and cathode of the thyristor, and a timer circuit for operating the trigger blocking circuit for a predetermined time period. The thyristor is turned ON by a trigger pulse TP2 from the trigger circuit. When the switch circuit is rendered ON, the timer circuit is operated. The trigger blocking circuit blocks the trigger pulse until the discharge of the commutation capacitor is completed. The thyristor is reverse biased by the commutation capacitor and shifted to the turn-off state. The carrier recombination capacitor is charged by part of a current from the commutation capacitor. A charge stored in the carrier recombination capacitor recombines a residual carrier of the gate region of the thyristor.

7 Claims, 12 Drawing Figures

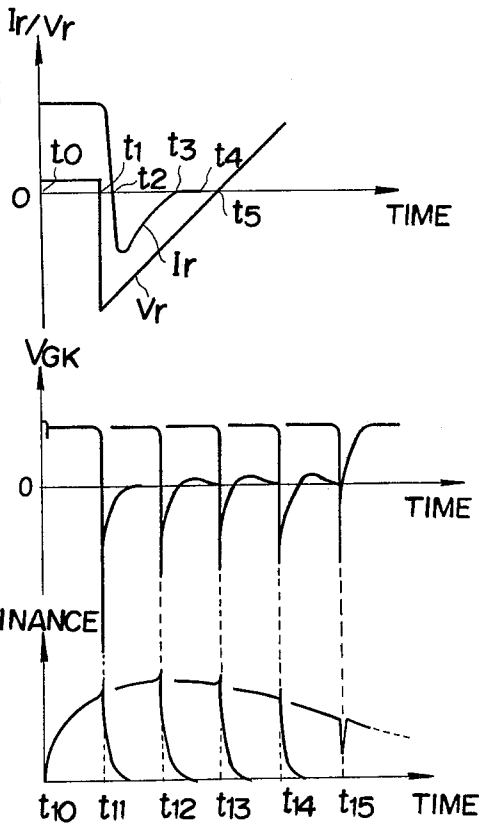
FIG.6
FIG.7
FIG.8
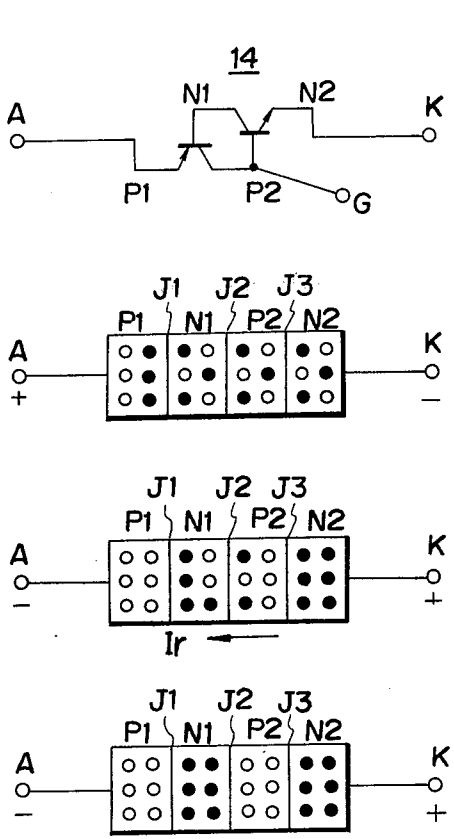
FIG.2
FIG.3
FIG.4
FIG.5

CONTROL CIRCUIT FOR FLASH TUBE APPARATUS

This invention relates to a control circuit for flash tube apparatus, which controls the flashing and extinguishing of a flash tube.

In a control circuit for a flash tube for photographing a thyristor or silicon controlled rectifier (SCR) is often used as a switching element for controlling the flashing and extinguishing of the flash tube. The thyristor used there has to be positively turned ON when the flash unit should be flashed and be positively turned OFF when the flash tube should be extinguished. In order to satisfy the above-mentioned requirements it is necessary that the thyristor be rapid in its switching operation. Normally, the switching speed of the thyristor depends upon its turn OFF time. Attempts to shorten the turn-OFF time and positively turn the thyristor OFF have been made up to date. For example, U.S. Pat. No. Re. 28025 discloses such a circuit arrangement. Though the circuit arrangement successfully improves such a switching speed, a thyristor used there is liable to deterioration due to a greater reverse bias applied between the gate and cathode of the thyristor. A circuit arrangement free from such a defect is shown, for example, in Japanes patent publication 30905/69.

However, such circuit arrangement is slow in its switching speed and it is difficult for a thyristor to be positively turned ON.

It is accordingly the object of this invention to provide a control circuit for flash tube apparatus, which can shorten the turn-OFF time of a thyristor for controlling the flashing and extinguishing of a flash tube and prevent mis-triggering of the thyristor.

To attain such object there is provided according to this invention a control circuit comprising (a) a charge capacitor charged by a high voltage generator;

(b) a flash tube coupled in parallel with the charge capacitor;

(c) a thyristor whose anode to cathode path being connected between the discharge capacitor and the flash tube for controlling the flash tube in ON-OFF fashion;

(d) a trigger circuit coupled with a trigger electrode of the flash tube and gate of the thyristor to trigger the flash tube and thyristor;

(e) a commutation capacitor coupled in parallel with the anode and cathode of the thyristor;

(f) a precharge circuit for precharging the commutation capacitor;

(g) a switch circuit connected between the commutation capacitor and the thyristor, said switch circuit being such that when it is render ON it causes a reverse voltage resulting from a charge stored in the commutation capacitor to be connected parallel with the thyristor to permit the thyristor to be turned OFF;

(h) a timing circuit for turning the switch circuit ON;

(i) a carrier recombination capacitor connected in parallel with the gate and cathode of the thyristor to reduce the turn-OFF time;

(j) a trigger blocking circuit connected between the trigger circuit and the gate of the thyristor to prevent a trigger signal supplied to the gate of the thyristor; and (k) a timer circuit connected between the switch circuit and the trigger blocking circuit to prevent a supply of said trigger signal to said gate of the thyristor during a predetermined trigger signal blocking period.

With the control circuit according to this invention carriers stored in the gate region of the thyristor are recombined by charges stored in a carrier recombination capacitor. In consequence, the turn-OFF time of the thyristor can be effectively shortened. Between the trigger circuit and the gate of the thyristor is connected a trigger blocking circuit for blocking a gate trigger pulse during a time period from the turning ON of the thyristor until the discharge of a commutation capacitor is substantially completed. In consequence, the thyristor is prevented from being triggered during a time period from the turning ON of the thyristor until the state is reached in which the next turning ON can be normally effected. That is, the mis-triggering of the thyristor can be positively prevented. An amount of charges stored in the carrier recombination capacitor is substantially proportional to a small reverse current flowing into the gate of the thyristor immediately before the thyristor is turned OFF. The above-mentioned amount of charges is a minimal one necessary and sufficient to turn the thyristor OFF within a short time period, and thus any excess reverse bias is not applied between the gate and cathode of the thyristor. Accordingly, the thyristor is prevented from being deteriorated.

This invention will be now explained below by referring to the accompanying drawings in which:

FIG. 2 is an equivalent circuit of a thyristor of FIG. 1;

FIG. 3 shows a carrier distribution model when the thyristor of FIG. 2 is turned ON, white and black dots of this Figure showing holes and electrons respectively;

FIG. 4 shows a carrier distribution model on a transient shift to the turn OFF state of the thyristor of FIG. 3, white dots in an N1 region and black dots in a P2 region showing persistent carriers resulting from a carrier storage effect;

FIG. 5 shows a carrier distribution model when the persistent carriers are erased from the thyristor at the state of FIG. 4 through recombination, this Figure showing a state in which the switching control capability of the thyristor is completely recovered;

FIG. 6 shows a relation of the carrier distributions of FIGS. 3 to 5 to a reverse current flowing through the cathode to the anode of the thyristor, FIG. 3 corresponding to a carrier distribution at time $t_0$ to $t_1$ of FIG. 6, FIG. 4 a carrier distribution at time $t_3$ of FIG. 6 and FIG. 5 a carrier distribution at time $t_4$ of FIG. 6;

FIGS. 7 and 8 are waveforms showing a mis-triggering at time $t_{15}$ where no trigger blocking circuit 18 of FIG. 1 is provided, FIG. 7 showing a waveform of a gate-to-cathode voltage $V_{GK}$ and FIG. 8 a waveform of the emission of a flash tube of FIG. 1.

Figure 1:
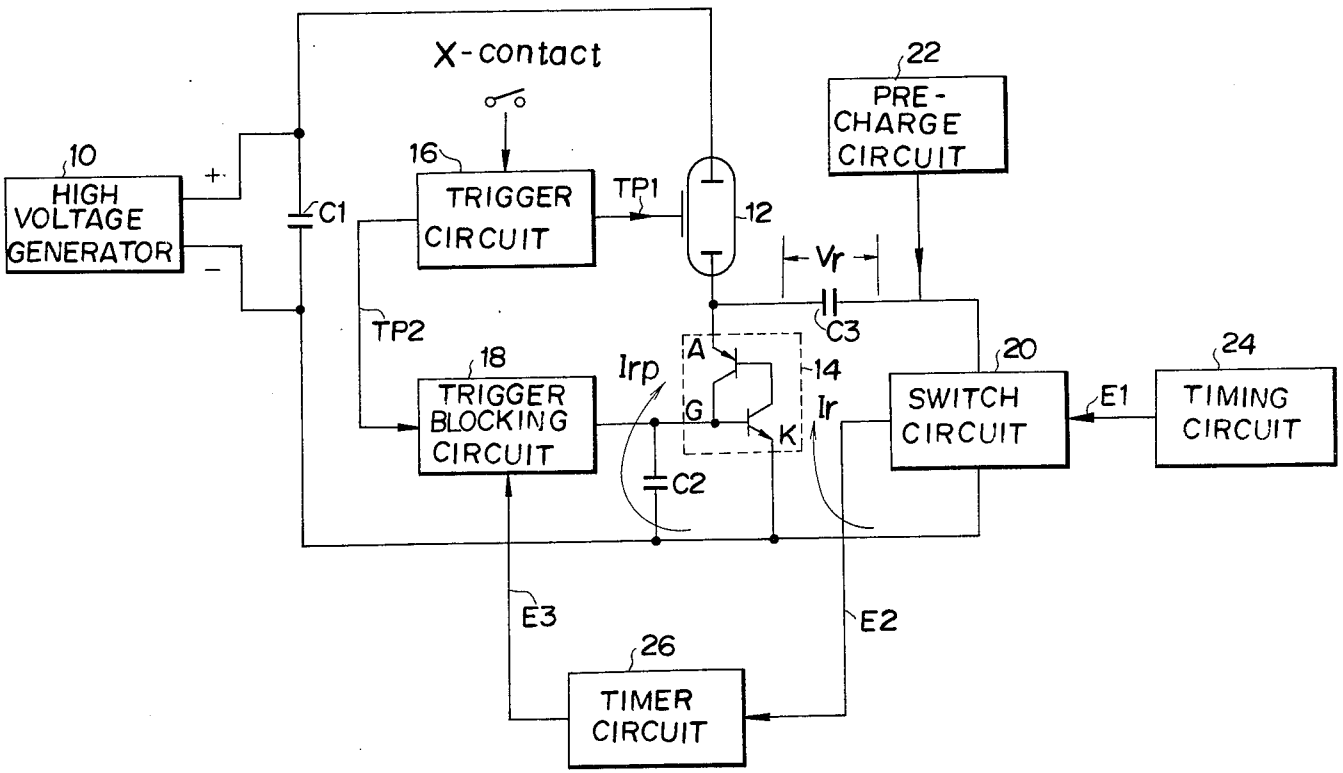
FIG. 1 is a block diagram showing a fundamental arrangement of flash tube apparatus including a control circuit according to this invention.
Figure 9:
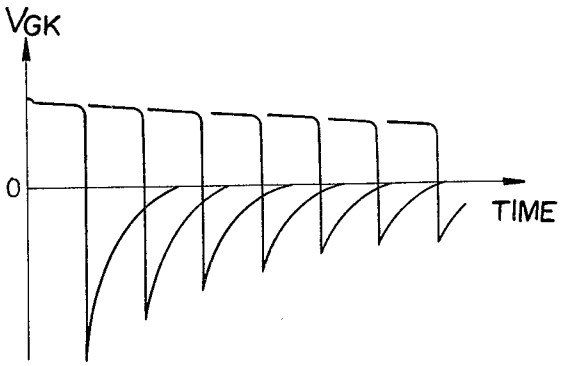
Figure 10:
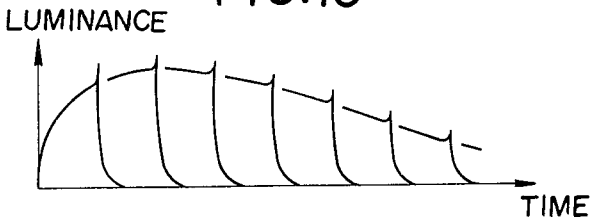

FIGS. 9 and 10 show waveforms showing an absence of any mis-triggering where the trigger blocking circuit 18 of FIG. 1 is provided, FIGS. 9 and 10 correspond to FIGS. 7 and 8, respectively.

Figure 12:
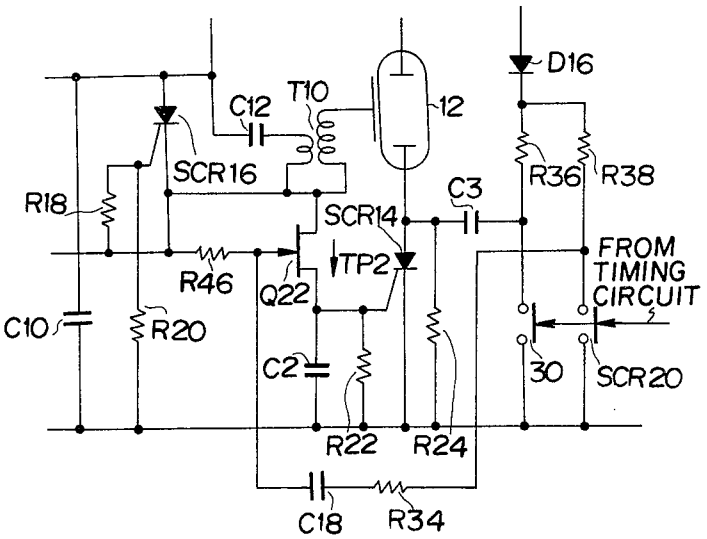
Figure 11:
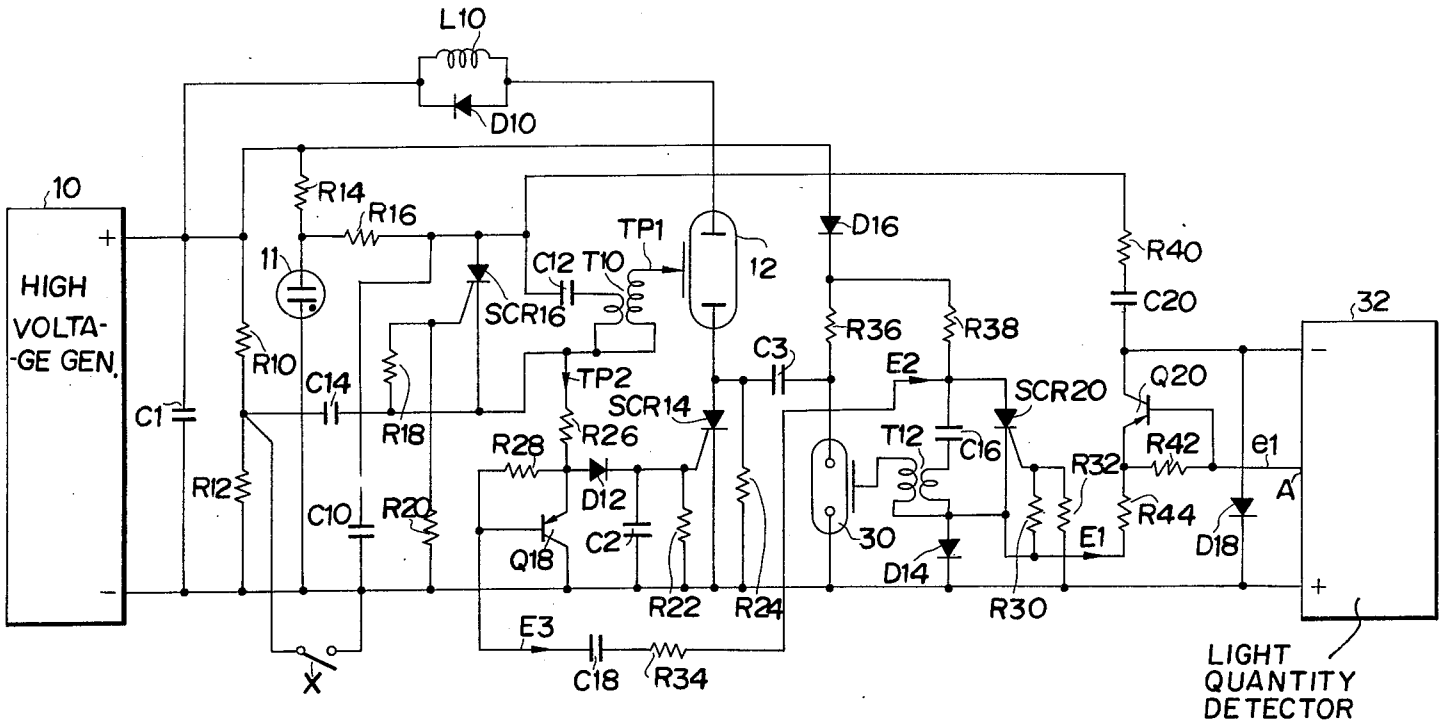

FIG. 11 is a detailed circuit diagram showing the arrangement of FIG. 1; and FIG. 12 shows a circuit showing a modified form of the trigger blocking circuit 18 in the circuit arrangement of FIG. 11.

A flash tube apparatus according to a preferred embodiment of this invention will now be explained below. Like numerals are employed to designate like parts throughout the specification so as to avoid a duplication of explanation.

FIG. 1 is a block diagram showing a fundamental arrangement of flash tube apparatus according to this invention. The output voltage of high voltage generator 10 is supplied to a discharge C1. As the high voltage generator, a DC-DC conventor is normally used. A voltage charged into the capacitor C1 is about 300 V. One end, for example the positive end, of the capacitor C1 is connected to one terminal of a flash tube 12. The other terminal of the flash tube 12 is connected to the anode of a thyristor device 14. The cathode of the thyristor 14 is connected to the other end or a negative end of the capacitor C1. Between the gate and the cathode of the thyristor 14 is connected a carrier-recombination capacitor C2 which will be explained later. A high voltage trigger pulse TP1 from a trigger circuit 16 is supplied to a trigger electrode of the flash tube 12. The trigger circuit 16 produces a trigger pulse TP1 when, for example, an X-contact is rendered ON. A trigger pulse TP2 is also produced upon the turning ON of the X-contact. The trigger pulse TP2 is supplied to the gate of the thyristor 14 through a trigger blocking circuit 18.

The anode of the thyristor 14 is connected to the cathode thereof through a commutation capacitor C3 and switch circuit 20. A precharge circuit 22 is connected to the capacitor C3. The capacitor C3 is fully charged by the precharge circuit 22 before the switch circuit 20 is turned ON. The switch circuit 20 is turned ON by a turn-ON instruction signal E1 from a timing circuit 24. When the switch circuit 20 is turned ON, a reverse-biased voltage $V_r$ which is charged in the capacitor C3 is applied between the anode and the cathode of the thyristor 14. The switch circuit 20 designates a pulse blocking timing of the trigger blocking circuit 18 and produces a timing signal E2 upon the turning ON of the switch circuit 20 or a little earlier than the turning ON of the switch circuit 20. The timing signal E2 is converted by a timer circuit 26 to a blocking instruction signal E3 for giving a pulse blocking time. The blocking circuit 18 prevents leak current, noises etc. from being supplied to the gate of the thyristor 14 when it receives the blocking instruction signal E3.

The fundamental operation of the circuit of FIG. 1 will now be explained below by referring to FIGS. 2 to 10.

Now suppose that the capacitors C1 and C3 are fully charged and that the capacitor C2 is fully discharged. Before the X-contact is turned ON, no turn-ON instruction signal E1 is produced. That is, the switch circuit 20 is in the OFF state. Since no timing signal E2 is produced, no blocking instruction signal E3 is also produced. Namely, the trigger blocking circuit 18 is in such a state that the trigger pulse TP2 can pass through the circuit 18 to the gate of the thyristor 14. When the X-contact is turned ON, the trigger circuit 16 delivers a trigger pulse TP1 to the trigger electrode of the flash tube 12. At the same time, the trigger circuit 16 delivers a trigger pulse TP2 to the gate of the thyristor 14 through the trigger blocking circuit 18. When the flash tube 12 and thyristor 14 are triggered by the trigger pulses TP1 and TP2 respectively, the thyristor 14 is turned ON and the flash tube emits a flash.

FIG. 2 shows an equivalent circuit of the thyristor 14 and FIG. 3 shows a carrier distribution model when the thyristor 14 is turned ON. In FIG. 3 white dots show holes and black dots show electrons. The state of these dots corresponds to the time $t_0$ in FIG. 6.

Suppose that the timing circuit 24 is constructed of, for example, a conventional light-quantity detection circuit. If in this case the timing circuit 24 detects that a proper amount of light is given by the flash tube 12 to a photographic film (not shown), then the timing circuit 24 delivers a turn-ON instruction signal E1 to the switch circuit 20, causing the latter to produce a timing signal E2 while the circuit 20 being turned ON. When the switch circuit 20 is so turned ON, a reverse-biased voltage $V_r$ charged to the capacitor C3 is applied between the anode and the cathode of the thyristor 14. If the thyristor 14 is of a P-gate type PNPN junction SCR, the negative (−) and positive (+) polarity of the voltage $V_r$ are applied to the anode (A) and cathode (K) respectively of the thyristor 14. The time $t_1$ of FIG. 6 corresponds to the instant at which the switch circuit 20 is turned ON. When this occurs, the thyristor 14 undergoes a forced commutation and is shifted to the turn-ON state.

FIG. 4 shows a carrier distribution immediately after reverse current $I_r$ completes its flow on a transient shift to the turn-ON state. That is, when the junctions J1 and J3 are reverse-biased by the voltage $V_r$ on a switching transition from the forward-biased state of FIG. 3 to the reverse-biased state, reverse current $I_r$ flows due to a carrier storage effect at the gate (P2/N1) region. The carrier storage effect is always involved when a high-speed switching is effected using a semiconductor device having a bipolar transistor structure. The reverse current $I_r$ resulting from the discharge of the capacitor C3 flows during the time $t_2$ to $t_3$ to FIG. 6. Even if, however, the time $t_2$ to $t_3$ is passed, carriers persists in the gate (P2/N1) region during a very small time $t_3$ to $t_4$ owing to the carrier storage effect. If forward bias is applied to the thyristor 14 at time $t_1$ to $t_4$, the thyristor 14 is turned ON without receiving a trigger pulse TP2. That is, the thyristor 14 is erroneously triggered. To prevent such a phenomenon, the application of the forward bias has to wait until carriers (electrons/holes) at the gate (P2/N1) region are completely erased by recombination. In other words, in order to prevent an adverse influence from the carrier storage effect the thyristor 14 should not be forward-biased during a time $t_1$ to $t_4$ from the turning ON of the switch circuit 20 to the erasure of carriers at the gate (P2/N1) region. The time $t_1$ to $t_4$ is called a turn-OFF time and is a greatest cause for the switching speed reduction of the thyristor.

To alleviate the switching speed reduction of the thyristor resulting from the above-mentioned carrier storage effect, it is only necessary that the recombination of carriers at the gate (P2/N1) region be expedited during the switching transition period. According to this invention, the speeding up of the recombination of carriers is attained by a carrier-recombination capacitor C2.

The speeding up of the carrier recombination by the capacitor C2 would be effected as follows.

At time $t_2$ to $t_3$ some of reverse current $I_r$ i.e. a partial reverse current $I_{rp}$ flows into the capacitor C2. The partial reverse current $I_{rp}$ corresponds to a flow of carriers which are recombined at the gate (P2/N1) region of the thyristor 14. The capacitor C2 is charged by the partial reverse current $I_{rp}$. At this time, an electrostatic energy $E_{C2}$ stored in the capacitor C2 is determined by the cathode-to-gate voltage $V_{KG}$ and partial reverse current $I_{rp}$. At time $t_3$ in FIG. 6 the discharge of the commutation capacitor C3 is completed and, when the reverse current $I_r$ becomes zero, the cathode-to-gate path is reverse biased by a voltage across the capacitor C2. That is, an amount of charge corresponding to the electrostatic energy $E_{C2}$ is injected into the gate of the thyristor 14. The persistent carriers in the gate (P2/N1) region as shown in FIG. 4 is recombined rapidly by the charge injection. By so doing, the carriers are erased at a very short time from the gate (P2/N1) region. When the state as shown in FIG. 5 is attained, the thyristor 14 is completely turned OFF. It is important to note that the speeding up of carrier recombination by the capacitor C2 inflicts no excess burden to the gate (G) of the thyristor 14. The partial reverse current $I_{rp}$ immediately before the thyristor 14 is turned OFF is stored in the capacitor C2. The injected current resulting from a release of charges stored in the capacitor C2 is enough to recombine the persistent carriers of the thyristor 14, but not of such an order as to impart an excess load to the thyristor 14.

As mentioned above, the turn-ON time of the thyristor 14 is shortened by the carrier recombination capacitor C2. When, however, the commutation capacitor C3 is recharged by a current when carriers at the gate region are forcedly recombined through utilization of charges in the capacitor C2, the thyristor 14 will be easily mis-triggered. The recharged commutation capacitor C3 applies a reverse bias as shown in FIG. 5 between the anode and the cathode of the thyristor 14. When at this state any current, however small it is, flows into the gate (G) of the thyristor 14 the thyristor 14 will be turned ON. That is, the thyristor 14 is erroneously turned ON. It is therefore required that a current flowing from the trigger blocking circuit 18 into the gate (G) of the thyristor 14 be positively interrupted during the time period in which the thyristor 14 should be held in the OFF state. This time period corresponds to the time $t_1$ to $t_5$ i.e. the time period in which the discharge of the commutation capacitor C3 is completed. The above-mentioned requirement is satisfied by the trigger blocking circuit 18 and timer circuit 26. When the turn-ON instruction signal E1 is supplied after the thyristor 14 is turned ON, the switch circuit 20 produces a timing signal E2 and the commutation capacitor C3 is discharged. The timing of the discharge and of the timing signal E2 may be theoretically coincident. In order to positively prevent the erroneous mis-triggering of the thyristor 14, however, the timing signal E2 may be produced prior to the discharge of the capacitor C3. When the timing signal E2 is produced, the timer circuit 26 delivers the blocking instruction signal E3 to the trigger blocking circuit 18. When the instruction signal E3 is given, the blocking circuit 18 prevents a flow of a current into the gate (G) of the thyristor 14. The blocking operation of the trigger blocking circuit 18 is effective while the instruction signal E3 is being given. The trigger blocking period i.e. the period in which the instruction signal E3 is being given, is determined by the timer circuit 26. The timer circuit 26 can be constructed of a CR circuit having, for example, a predetermined time constant.

FIGS. 7 and 8 show the mis-triggering state as occuring when the trigger blocking circuit 18 is not provided. These Figures show the continuous state in which an illuminating or automatic flash control is effected. FIG. 7 shows the waveform of the gate-to-cathode voltage $V_{GK}$ of the thyristor and FIG. 8 shows the flashing waveform of the flash tube. At time $t_{10}$ to $t_{14}$ the thyristor 14 is correctly controlled in ON-OFF fashion. At time $t_{15}$ the thyristor 14 is turned ON before the thyristor 14 is completely turned OFF. A cause for such mis-triggering can be considered as follows. The smaller the above-mentioned partial reverse current $I_{rp}$, the smaller the reverse voltage ($-V_{GK}$) charged in the carrier-recombination capacitor C2. When the reverse voltage ($-V_{GK}$) charged in the capacitor C2 is enough great, no mis-triggering occurs even if some gate current (this is not a regular trigger pulse TP2) flowing from the blocking circuit 18 side into the gate (G) of the thyristor 14 is present. It is because that since the gate current imparts a foward voltage ($+V_{GK}$) to the capacitor C2 the gate current is absorbed in the reversely charged ($-V_{GK}$) capacitor C2. However, if the reverse voltage ($-V_{GK}$) is made smaller, the capacitor C2 can not completely absorb the gate current, thus involving such mis-triggering.

FIGS. 9 and 10 show the case where the blocking circuit 18 is provided. In this case, no gate current flows into the thyristor 14 during the time period in which the blocking instruction signal E3 is given i.e. the thyristor 14 should be held in the OFF state. Thus, no mis-triggering occurs.

FIG. 11 shows a detailed circuit of the blocking circuit of FIG. 1. A capacitor C1 is connected across, and in parallel with, a high voltage generator 10. The positive terminal of the high voltage generator 10 is connected to the negative terminal thereof through resistors R10 and R12. Assume that the negative terminal of the high voltage generator 10 is grounded. The positive terminal of the generator 10 is connected to the anode of a thyristor or a silicon-controlled rectifier (SCR) 16 through a series circuit of resistors R14 and R16. A junction of the resistors R14 and R16 is grounded through a neon tube 11. The neon the 11 is used as an indicator showing whether or not a charged voltage of the capacitor C1 reaches a predetermined value. The neon tube 11 also serves to stabilize a voltage on the junction between the resistors R14 and R16. The anode of SCR 16 is grounded through a capacitor C10. The anode of SCR16 is connected to the cathode thereof through a capacitor C12 and a primary coil of a pulse transformer T10. The gate of SCR16 is connected to its cathode through resistor R18. The gate of SCR16 is grounded through a resistor R20. The cathode of SCR16 is connected through a capacitor C14 to a junction between the resistors R10 and R12. This junction is grounded through the X-contact. The resistors R10 to R20, capacitors C10 to C14, SCR16 and pulse transformer T10 constitute a trigger circuit 16 of FIG. 1.

A trigger pulse TP1 induced in a secondary coil of the pulse transformer T10 is applied to the trigger electrode of a flash tube 12. A first flash electrode of the flash tube 12 is connected to the positive terminal of the generator 10 through a storage current limiting coil L10. A pulse absorption diode D10 is connected parallel with the coil L10 such that its cathode is oriented toward the high voltage generator 10 side. A second flash electrode of the flash tube 12 is connected to the anode of a thyristor or SCR14. The cathode of SCR14 is grounded and the gate of SCR14 is grounded through a parallel circuit of a resistor R22 and carrier-recombination capacitor C2. A resistor R24 is connected parallel with, and across, SCR14. The cathode of a SCR16 is connected through a resistor R26 to the anode of a diode D12. The cathode of the diode D12 is connected to the gate of the SCR14. That is, a trigger pulse TP2 derived from the cathode circuit of SCR16 is supplied to the gate circuit of SCR14. The anode of the diode D12 is grounded through the emitter-to-collector path of a PNP transistor Q18. A resistor R28 is connected parallel with the transistor Q18 and across the emitter-to-base path of the transistor Q18. The resistors R26 and R28, diode D12 and transistor Q18 constitute the trigger blocking circuit 18. A P-channel enhancement mode field effect transistor (FET) may be used as the transistor Q18. When the transistor Q18 is turned ON, a junction between the resistor R26 and diode D12 is substantially grounded. Thus, the trigger pulse TP2 is completely shunted by the transistor Q18 and can not be transmitted to the gate of SCR14.

One terminal of the commutation capacitor C3 is connected to the anode of SCR14. The other terminal of the capacitor C3 is grounded through a switch discharge tube or arrester 30. One end of a secondary coil of a pulse transformer T12 is connected to the trigger electrode of the arrester 30. One end of a primary coil of the pulse transformer T12 is connected to the anode of SCR20 through a capacitor C16. The other terminal of the primary coil of the pulse transformer T12, together with the other end of the secondary coil thereof, is connected to the cathode of SCR20. The gate of SCR20 is connected to the cathode thereof through a resistor R30. The gate of SCR20 is grounded through a resistor R32. The cathode of SCR20 is grounded through the anode-to-cathode path of the diode D14. SCR20 is turned ON by a negative trigger signal, i.e. a turn-ON instruction signal E1 supplied to the cathode of SCR20, current resulting from the discharge of the capacitor C16 flows through the primary coil of the pulse transformer T12. As a result, the arrester 30 is triggered. When SCR20 is turned ON, a timing signal E2 is produced from the anode of SCR20.

The resistors R30 and R32, the capacitor C16, the pulse transformer T12, the diode D14, the SCR20 and the arrester 30 constitute the switch circuit 20 of FIG. 1.

The anode of SCR20 is connected to the base of the transistor Q18 through a series output of a resistor R34 and capacitor C18. When SCR20 is turned ON, a current resulting from the discharge of the capacitor C18 flows through the base of the transistor Q18. That is, SCR20 is turned ON and at the same time the transistor Q18 is turned ON. Thus, the trigger pulse TP2 ceases to be supplied to the gate circuit of SCR14. The trigger pulse TP2 blocking period i.e. the period in which the transistor Q18 is turned ON can be varied by a substantial time constant of the discharge circuit of the capacitor C18. To explain in more detail, the greater the DC amplification factor $h_{FE}$ of the transistor Q18, resistance values of the resistors R20, R18, R26, R28 and R34 and capacitance of the capacitor C18 and the greater the charging voltage of the capacitor C18, the longer the trigger pulse TP2 blocking time period. The capacitor C18 and resistor R34 constitute the timer circuit 26.

A junction between the capacitor C3 and the arrester 30 is connected to the cathode of a diode D16 through resistor R36. The anode of SCR20 is connected to the cathode of the diode D16 through a resistor R38. The anode of the diode D16 is connected to the positive terminal of the high voltage generator 10. The capacitor C3 is precharged, by the output voltage of the generator 10 or charging voltage of the capacitor C1, through the diode D16 and resistor R36. Likewise, the capacitors C16 and C18 are precharged through the diode D16 and resistor R38. The diode D16 and resistors R36 and R38 constitute the precharge circuit 22.

The anode of SCR16 is connected to the negative power supply input terminal of a light quantity detector 32 through a series circuit of the resistor R40 and capacitor C20. A circuit arrangement disclosed in USP. 3340426 can be used as the light quantity detector 32. The positive power supply input terminal of the detector 32 is grounded. A zener diode D18 is connected parallel with, and across, the detector 32 so that a power supply voltage is set to a predetermined value. The base of a PNP transistor Q20 is connected to an output terminal A of the detector 32. The collector of the transistor Q20 is connected to the negative power supply input terminal of the detector 32. The base of the transistor Q20 is connected to the emitter thereof through a resistor R42. The emitter of the transistor Q20 is connected to the cathode of SCR20 through a resistor R44.

When a predetermined quantity of hight is detected by the detector 32 the detector 32 produces an output signal e1. A current resulting from the output signal e1 flows from the positive power supply input terminal of the detector 32 to the emitter-to-base path of the transistor Q20 through resistors R32 and R30. In consequence, the transistor Q20 is turned ON. The positive power supply input terminal of the detector 32 is connected to the negative power supply input terminal thereof through the resistors R32 and R30 and emitter-to-collector path of the transistor Q20. At this time, the collector current of the transistor Q20 becomes the above-mentioned turn-ON instruction signal E1. When the SCR16 is turned ON the capacitor C20 which has been precharged is discharged, causing electric current to be passed through the following current path to permit the detector 32 to be operated. That is, only when the discharge current of the capacitor C20 flows through a loop C20→R40→SCR16→R26→D12→R22→D18→C20, a power supply energy is supplied to the detector 32. The resistors R40 to R44, transistor Q20, zener diode D18 and light quantity detector 32 constitute the timing circuit 24 of FIG. 1.

The circuit arrangement of FIG. 11 permits accurate and positive ON-OFF control of the thyristor 14 and thus is switable for an automatic exposure control of photographing apparatus.

FIG. 12 shows a modified form of the trigger blocking circuit 18 of FIG. 11. In the circuit of FIG. 11 the trigger circuit TP2 is shunted by the transistor Q18. That is, the transistor Q18 provides a parallel switch circuit. The circuit of FIG. 12, on the other hand, is constituted of a series switch circuit. That is, the cathode of an SCR16 is connected to the gate of an SCR14 through a source-to-drain path (or a drain-to-source path) of a field effect transistor (FET) Q22. FET Q22 is suitably of an N-channel depletion mode junction type. The rank of $I_{DSS}$ of FET Q22 can be determined taking into consideration the magnitude of the discharge current of the capacitor C20 shown in FIG. 11. When SCR20 is in the OFF state, the internal resistance of FET Q22 is low since the gate bias of FET Q22 is zero. That is, the trigger pulse TP2 is in such a state that it passes there without being blocked. When SCR20 is turned ON, FET Q22 is cut off by a voltage corresponding to the stored charge of the capacitor C18. At this time, a supply of the trigger pulse TP2 to SCR14 is blocked.

In the circuit of FIG. 11 the blocking time period of the trigger pulse TP2 is somewhat varied by a temperature. This is due to the temperature dependence of a DC amplification factor $h_{FE}$ of the transistor Q18. In the circuit of FIG. 12 a temperature variation of the above-mentioned blocking time period is smaller. It is because that the magnitude of the temperature coefficient of a pinch-off voltage $V_p$ of FET is far smaller than that of $h_{FE}$ of a bipolar transistor. Where the trigger blocking circuit of FIG. 12 is applied to FIG. 11 a power supply current of the light quantity detector 32 flows through FET Q22. In consequence, a type with a relatively great dissipation and great current is used as FET Q22.

Although a specific circuit has been illustrated and described herein, it is not intended that the invention be limited to the elements and circuit arrangements disclosed herein. One skilled in the art will recognize the particular elements or subcircuits may be used without departing from the scope and spirit of the invention.

What is claimed is:

1. A control circuit for a flash light apparatus comprising (a) a charge capacitor charged by a high voltage generator;

(b) a flash tube coupled in parallel with the charge capacitor;

(c) a thyristor whose anode to cathode path being connected between the discharge capacitor and the flash tube for controlling the flash tube in ON-OFF fashion;

(d) a trigger circuit coupled with a trigger electrode of the flash tube and gate of the thyristor to trigger the flash tube and thyristor;

(e) a commutation capacitor coupled in parallel with the anode and cathode of the thyristor;

(f) a precharge circuit for precharging the commutation capacitor;

(g) a switch circuit connected between the commutation capacitor and the thyristor, said switch circuit being such that when it is rendered ON it causes a reverse voltage resulting from a charge stored in the commutation capacitor to be connected parallel with the thyristor to permit the thyristor to be turned OFF:

(h) a timing circuit for turning the switch circuit ON;

(i) a carrier recombination capacitor connected in parallel with the gate and cathode of the thyristor to reduce the turn-OFF time;

(j) a trigger blocking circuit connected between the trigger circuit and the gate of the thyristor to prevent a trigger signal supplied to the gate of the thyristor; and (k) a timer circuit connected between the switch circuit and the trigger blocking circuit to prevent a supply of said trigger signal to said gate of the thyristor during a predetermined trigger signal blocking period, said predetermined trigger signal blocking time substantially corresponding to a period from the turning ON of said switch circuit until said commutation capacitor is substantially discharged.

2. A control circuit according to claim 1 in which said trigger blocking circuit includes a switching element coupled in parallel with a circuit present between the gate and cathode electrodes of said thyristor, said switching element being such that it is turned ON for said predetermined trigger signal blocking time when said switching circuit is turned ON.

3. A control circuit according to claim 1 in which said trigger blocking circuit includes a switching element connected in series with the gate circuit of said thyristor, said switching element being such that it is turned OFF when said switching circuit is turned ON.

4. A control circuit according to claim 1, 2 or 3 in which said timer circuit is comprised of a CR charge and discharge circuit.

5. A control circuit according to claim 1, 2 or 3 in which said timing circuit includes a light quantity detector, said light quantity being such that it produces a signal for giving a timing for the turning ON of said switch circuit, when a light quantity resulting from the emission of said flash tube reaches a predetermined value.

6. A control circuit according to claim 2 in which said switching element is a bipolar transistor.

7. A control circuit according to claim 3 in which said switching element is a depletion mode field effect transistor.

* * * * *

UNITED STATES PATENT AND TRADEMARK OFFICE

CERTIFICATE OF CORRECTION

PATENT NO. : 4,258,294

DATED : March 24, 1981

INVENTOR(S) : Masafumi Yamasaki

It is certified that error appears in the above—identified patent and that said Letters Patent is hereby corrected as shown below:

Column 4, line 26, "ON" should read -- OFF --;
29, "ON" should read -- OFF --;
Column 5, line 26, "ON" should read -- OFF --;

Signed and Sealed this

Second Day of March 1982

[SEAL]

Attest:

GERALD J. MOSSINGHOFF

Attesting Officer

Commissioner of Patents and Trademarks